US012029234B2

(12) United States Patent
Ichitsubo et al.

(10) Patent No.: US 12,029,234 B2
(45) Date of Patent: Jul. 9, 2024

(54) NON-COMBUSTION TYPE INHALATION ARTICLE

(71) Applicant: JAPAN TOBACCO INC., Tokyo (JP)

(72) Inventors: Hirokazu Ichitsubo, Tokyo (JP); Yusuke Nanasaki, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 147 days.

(21) Appl. No.: 16/046,703

(22) Filed: Jul. 26, 2018

(65) Prior Publication Data

US 2018/0325163 A1 Nov. 15, 2018

Related U.S. Application Data

(63) Continuation of application No. PCT/JP2016/054747, filed on Feb. 18, 2016.

(51) Int. Cl.

| | |
|---|---|
| ***A24D 1/20*** | (2020.01) |
| ***A24B 13/00*** | (2006.01) |
| ***A24B 15/28*** | (2006.01) |
| ***A24D 1/00*** | (2020.01) |
| ***A24D 1/22*** | (2020.01) |
| ***A24F 42/20*** | (2020.01) |

(52) U.S. Cl.

CPC ..... *A24B 13/00* (2013.01); *A24B 15/28* (2013.01); *A24B 15/287* (2013.01); *A24D 1/002* (2013.01); *A24D 1/20* (2020.01); *A24D 1/22* (2020.01); *A24F 42/20* (2020.01)

(58) Field of Classification Search

None

See application file for complete search history.

(56) References Cited

U.S. PATENT DOCUMENTS

| | | | | |
|---|---|---|---|---|
| 5,074,321 | A | 12/1991 | Gentry et al. | |
| 5,692,525 | A | 12/1997 | Counts et al. | |
| 7,165,553 | B2 | 1/2007 | Luan et al. | |
| 2005/0098187 | A1 * | 5/2005 | Grierson | A24B 3/14 131/364 |
| 2007/0215168 | A1 | 9/2007 | Banerjee et al. | |
| 2008/0092912 | A1 * | 4/2008 | Robinson | A24B 13/02 131/200 |
| 2010/0024834 | A1 * | 2/2010 | Oglesby | A24F 42/60 131/194 |
| 2011/0297166 | A1 | 12/2011 | Takeuchi et al. | |

(Continued)

FOREIGN PATENT DOCUMENTS

| | | |
|---|---|---|
| EP | 0 162 476 A2 | 11/1985 |
| EP | 2 241 203 A2 | 10/2010 |
| EP | 2 399 637 A1 | 12/2011 |

(Continued)

OTHER PUBLICATIONS

English translation of International Preliminary Report on Patentability and Written Opinion dated Aug. 30, 2018, in PCT/JP2016/054747 (Forms PCT/IB/338, PCT/IB/373, and PCT/ISA/237).

(Continued)

*Primary Examiner* — Katherine A Will

(74) *Attorney, Agent, or Firm* — Birch, Stewart, Kolasch & Birch, LLP

(57) ABSTRACT

A non-combustion type inhalation article comprising a tobacco filler having a tobacco particle density of not more than 0.51 g/cm$^3$.

10 Claims, 4 Drawing Sheets

(56) References Cited

U.S. PATENT DOCUMENTS

2013/0160779 A1* 6/2013 Chida ..... A24F 42/60
131/355

FOREIGN PATENT DOCUMENTS

| | | | |
|---|---|---|---|
| JP | 2009-529872 | A | 8/2009 |
| JP | 5510968 | B2 | 6/2014 |
| TW | 178514 | | 2/1992 |
| WO | WO 96/32854 | A2 | 10/1996 |
| WO | WO 2006/073065 | A1 | 7/2006 |
| WO | WO 2008/108889 | A1 | 9/2008 |
| WO | WO 2010/095659 | A1 | 8/2010 |

OTHER PUBLICATIONS

Office Action for Canadian Application No. 3,012,584, dated May 22, 2019.
Extended European Search Report for European Application No. 16890547.9, dated Sep. 23, 2019.
International Search Report, issued in PCT/JP2016/054747, PCT/ISA/210, dated Apr. 5, 2016.
Office Action issued in Taiwanese Patent Application No. 105105871 dated May 15, 2017.
Written Opinion of the International Searching Authority, issued in PCT/JP2016/054747, PCT/ISA/237, dated Apr. 5, 2016.
Chinese Office Action for Chinese Application No. 201680082103.4, dated Jan. 16, 2023, with English translation.
Pengcheng, "Tobacoo Consumption Process" China Light Industry Publishing Company, Sep. 1999, p. 218 (9 pages total), with English translation.
European Notice of Opposition for corresponding European Application No. 16890547.9, dated Dec. 1, 2023.

* cited by examiner

NON-COMBUSTION TYPE INHALATION ARTICLE

CROSS-REFERENCE TO RELATED APPLICATIONS

This application is a Continuation Application of PCT Application No. PCT/JP2016/054747, filed Feb. 18, 2016, the entire contents of which are incorporated herein by reference.

BACKGROUND OF THE INVENTION

1. Field of the Invention

The present invention relates to a non-combustion type inhalation article.

2. Description of the Related Art

A combustion type smoking article such as a cigarette is one in which a user enjoys smoking flavor by burning a cut tobacco or a molded body of cut tobacco (hereinafter, both are collectively referred to as a tobacco filler).

In addition to such a combustion type smoking article, a non-combustion type inhalation article that offers flavor without burning a tobacco filler is known. For example, in International Publication No. 2010/095659, tobacco particles including cut tobacco, carbonate and a flavor are used as a tobacco filler, and the action of carbonate leads to a rich flavor in a flavor component and an improved sensation of tobacco-flavored air inhaling. In addition, in International Publication No. 2006/073065, a heat source is burned to heat a tobacco filler without burning the tobacco filler with the heat, and an aerosol containing a tobacco flavor component is generated to allow a user to inhale the tobacco flavor component.

In such a non-combustion type inhalation article, since the tobacco filler is not burned, there is a problem that the tobacco flavor component contained in the tobacco filler is hardly released. In order to release a desired amount of the tobacco flavor component, it is sufficient to increase a filling amount of the tobacco filler, which leads to an increase in cost.

BRIEF SUMMARY OF THE INVENTION

In order to solve the above problems in non-combustion type inhalation article, an object of the present invention is to provide a non-combustion type inhalation article capable of efficiently releasing a tobacco flavor component from a tobacco filler without increasing a filling amount of the tobacco filler.

The present inventors have found that by reducing the density of individual tobacco fillers, it is possible to efficiently release a tobacco flavor component from the tobacco filler in a non-combustion type inhalation article, and completed the present invention.

According to the present invention, there is provided a non-combustion type inhalation article comprising a tobacco filler having a tobacco particle density of not more than 0.51 g/cm$^3$.

The present invention can provide a non-combustion type inhalation article capable of efficiently releasing a tobacco flavor component from a tobacco filler.

DETAILED DESCRIPTION OF THE INVENTION

Figure 1:
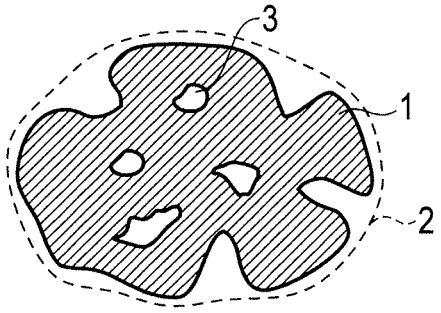
FIG. 1 is a view for explaining a volume of a tobacco filler.

Hereinafter, although the present invention will be described, the following description is for the purpose of detailed explanation of the present invention and is not intended to limit the present invention.

As used herein, "tobacco filler" refers to individual units constituting the total tobacco filler included in a non-combustion type inhalation article. The total tobacco filler included in the non-combustion type inhalation article is called "the total tobacco filler".

As described above, the non-combustion type inhalation article has a problem that it is difficult to release the tobacco flavor component as compared with a combustion type smoking article. Regarding this problem, the present inventors have considered that although the tobacco flavor component present near a surface of the tobacco filler is likely to be released into the atmosphere, the tobacco flavor component present inside the tobacco filler cannot move to the vicinity of the surface and thus is not released into the atmosphere, and this is the cause of the problem. Based on this idea, the present inventors have tried to efficiently move the tobacco flavor component, remaining inside the tobacco filler, to the vicinity of the surface of the tobacco filler and release more tobacco flavor components into the atmosphere. As a result of intensive studies, the present inventors have found that by reducing the density of individual tobacco fillers, it is possible to dramatically increase release efficiency of the tobacco flavor component in the non-combustion type inhalation article, and completed the present invention.

Specifically, the non-combustion type inhalation article of the present invention comprises a tobacco filler having a tobacco particle density of not more than 0.51 g/cm$^3$.

In the present invention, the "tobacco filler" may be either cut tobacco or a molded body of cut tobacco. The molded body of cut tobacco is one obtained by forming a tobacco raw material, including cut tobacco, into a predetermined shape. The molded body of cut tobacco may include tobacco scraps, such as leaf scraps and cut scraps, which are generated at leaf processing plants and manufacturing plants, in addition to the cut tobacco. The molded body of cut tobacco may be formed into a size suitable for inhalation articles or may be cut into a size suitable for inhalation articles after a large-sized molded body is molded. The molded body of cut tobacco has any shape such as a cylindrical column or a quadrangular prism, and the shape is preferably a hexahedron, more preferably a rectangular parallelepiped, and still more preferably a regular quadrangular prism. In order to maintain the shape as a molded body, the molded body of cut tobacco may contain at least one kind of binder selected from the group consisting of pullulan and hydroxypropyl cellulose, for example. The binder can be contained in such an amount that exerts the effect as the binder and does not lower a releasing property of the tobacco flavor component, and can be usually contained in an amount of 0.5 to 15% by mass relative to the total mass of the molded body of cut tobacco. Alternatively, when the shape of the molded body can be maintained even if the molded body of cut tobacco does not use the binder, the molded body of cut tobacco may not contain the binder. In a case where the binder inhibits the release of the tobacco flavor component from the molded body of cut tobacco, it is desirable not to contain the binder. The molded body of cut tobacco may contain a humectant to adjust the water content. As the humectant, polyhydric alcohols can be used, and examples thereof include glycerin, propylene glycol, sorbitol, xylitol, and erythritol. These polyhydric alcohols may be used alone or in combination of two or more. When the humectant is contained, the humectant can usually be contained in an amount of 5 to 15% by mass relative to the total mass of the molded body of cut tobacco. The molded body of cut tobacco may additionally contain a flavor material, and a solid or liquid flavor material may be used. Examples of the flavor material include menthol, spearmint, peppermint, cocoa, carob, coriander, licorice, orange peel rose pips, chamomile flour, lemon verbena, and saccharides (fructose and sucrose, etc.). The flavor material can usually be contained in an amount of 0.5 to 45% by mass relative to the total mass of the molded body of cut tobacco.

In the present invention, the tobacco filler has a tobacco particle density of not more than 0.51 g/cm$^3$, preferably not more than 0.50 g/cm$^3$, more preferably not more than 0.42 g/cm$^3$. The lower limit of the tobacco particle density of the tobacco filler can be, for example, 0.05 g/cm$^3$, preferably 0.20 g/cm$^3$.

Here, the "tobacco particle density" refers to the density of individual tobacco fillers. The "tobacco particle density" can be calculated as follows. First, the size of individual tobacco fillers is measured using a microscope to calculate the volume. In addition, the mass of the tobacco filler is measured by an electronic balance. The density of the tobacco filler is calculated from the obtained volume and mass, and the obtained value is taken as the "tobacco particle density". In the present specification, the "tobacco particle density" is also simply referred to as the density. Here, as shown in FIG. 1, when a concave portion is provided on a surface of a tobacco filler 1, it is assumed that the tobacco filler is present in the concave portion, and the size of a space 2 surrounded by an outer circumference of the assumed tobacco filler refers to the volume of the tobacco filler. In FIG. 1, reference numeral 3 denotes closed pores present inside the tobacco filler. In other words, the volume of the tobacco filler refers to the size of the smallest space defined by a closed surface (formed by planes and convex surfaces) surrounding the tobacco filler and having no concave surface. Thus, the volume of the tobacco filler includes the volume of the tobacco filler itself (including the volume of convex portions on the surface of the tobacco filler), the volume of the closed pores present inside the tobacco filler, and the volume of concave portions on the tobacco filler surface. The volume of the tobacco filler can be calculated, for example, by measuring the size of individual tobacco fillers using an optical microscope (VH-8000, VH-Z75 manufactured by Keyence Corporation).

A low-density tobacco filler as defined above can be prepared according to a known method. For example, low-density cut tobacco as defined above can be prepared by expansion treatment known in the art. A low-density molded body of cut tobacco as defined above can be prepared by expansion treatment known in the art or compression molding treatment with a small compressive force during compression molding. The molded body of cut tobacco obtained by reducing the compressive force during compression molding has a low possibility of losing the tobacco flavor component during preparation, as compared with the molded body of cut tobacco obtained by the expansion treatment, and thus it is preferable as a tobacco filler. As another method, the molded body of cut tobacco can be prepared by tumbling fluidizing granulation treatment, agitation mixing granulation treatment, extrusion molding treatment or the like which are well known in the technical field of the powder industry.

The non-combustion type inhalation article of the present invention contains a tobacco filler having a tobacco particle density of not more than 0.51 g/cm$^3$ in an amount of, preferably not less than 1% by mass, more preferably not less than 10% by mass, still more preferably not less than 20% by mass and not more than 100% by mass, with respect to the total tobacco filler contained in the article. The effect of the present invention becomes more prominent as the blending ratio of the tobacco filler having a tobacco particle density of not more than 0.51 g/cm$^3$ is higher.

In the present invention, the "non-combustion type inhalation article" is an article which allows a user to inhale the tobacco flavor component by inhalation without burning the tobacco filler. The "non-combustion type inhalation article" may be a non-heating type inhalation article which allows a user to inhale the tobacco flavor component without heating the tobacco filler (see, for example, International Publication No. 2010/095659). Alternatively, the "non-combustion type inhalation article" may be a heating type inhalation article which allows a user to inhale the tobacco flavor component by heating the tobacco filler to such an extent that it does not burn. Heating of the tobacco filler may be carried out by circulating air or aerosol, heated by a heat source disposed upstream of the tobacco filler, through the tobacco filler (see, for example, International Publication No. 2006/073065), or by warming the tobacco filler from the outside of an inhalation article with a heating device separate from the inhalation article (see, for example, International Publication No. 2010/110226).

In accordance with the present invention, application of the tobacco filler having a tobacco particle density of not more than 0.51 g/cm$^3$ to the non-combustion type inhalation article can greatly increase the release efficiency of the tobacco flavor component. More specifically, according to the present invention, in addition to being able to increase the amount of the tobacco flavor component released from the tobacco filler at an initial stage of inhalation (for example, 1 to 5 puffs), when inhalation is repeated plural times (for example, 6 to 50 puffs), the tobacco flavor component can be continued to be released. This effect is considered to be due to the fact that the porosity inside the tobacco filler increases, so that the density of the tobacco filler is lowered, whereby the tobacco flavor component present in a portion where release is not performed in the case of the tobacco filler having a usual density is released at the initial stage of inhalation. Further, this effect is considered to be due to the fact that the porosity inside the tobacco filler increases, so that the density of the tobacco filler is lowered, whereby the tobacco flavor component present inside the tobacco filler is likely to move to the surface of the tobacco filler, and the tobacco flavor component can continuously move to the surface of the tobacco filler even after the number of puffs increases.

As a low-density tobacco filler as defined above, tobacco fillers with added carbonate or hydrogencarbonate can be used. As the carbonate or hydrogencarbonate, for example, at least one selected from the group consisting of potassium carbonate, sodium carbonate, calcium carbonate, and sodium hydrogencarbonate can be used. The carbonate or hydrogencarbonate can be added in an amount of 5 to 22 parts by mass based on 100 parts by mass of the tobacco filler. The carbonate or hydrogencarbonate may be added during or after preparation of the tobacco filler. When the carbonate or hydrogencarbonate is added to the tobacco filler, it is expected that a non-combustion type inhalation article will provide a user with more preferred flavor.

In the present specification, the size of the tobacco filler can be represented by a surface area-equivalent sphere diameter (hereinafter also referred to as particle diameter) of the tobacco filler. The surface area-equivalent sphere diameter refers to a diameter of a sphere having the same surface area as a single tobacco filler. In the present invention, the tobacco filler preferably has a surface area-equivalent sphere diameter of not more than 1.0 mm, more preferably not more than 0.75 mm. The lower limit of the surface area-equivalent sphere diameter can be, for example, 0.036 mm, preferably 0.10 mm.

The 50% particle diameter (D50) of the total tobacco filler contained in the non-combustion type inhalation article of the present invention is preferably not more than 1.0 mm, more preferably not more than 0.75 mm.

When the size of the tobacco filler is set to not more than a predetermined size as described above and the total number of the tobacco fillers contained in the non-combustion type inhalation article is increased, the total surface area of the total tobacco filler contained in the non-combustion type inhalation article can be increased, whereby the amount of the tobacco flavor component released from the non-combustion type inhalation article can be increased.

On the other hand, the size of the tobacco filler can be expressed with the maximum length of the tobacco filler from the viewpoint of ease of manufacture of the non-combustion type inhalation article (such as the fluidity of the tobacco filler, a filling method, and practical draw resistance of a filled column). The maximum length of the tobacco filler is generally not less than 0.05 mm, preferably not less than 0.1 mm, more preferably not less than 0.5 mm. Considering portability of the non-combustion type inhalation article, it is desirable that the maximum length of the tobacco filler be not more than the size (21 mm) of the tobacco filler used in the experiment described below. The above-described size (maximum length) may be a diameter (sieve diameter) obtained by sieving with a sieve or the size observed with a microscope or the like.

When a concave portion is provided on the surface of the tobacco filler, it is assumed that the tobacco filler is present in the concave portion, and the "surface area of the tobacco filler" (hereinafter simply referred to as the surface area) in the present specification refers to the surface area of the assumed tobacco filler. In other words, the surface area of the tobacco filler refers to the smallest area of a closed surface (formed by planes and convex surfaces) surrounding the tobacco filler and having no concave surface. This is equal to the surface area that can be calculated from the above-described surface area-equivalent sphere diameter by using the sphere surface area formula.

As a method of measuring the size of the tobacco filler, it is preferable that, after confirming the shape using an optical microscope (VH-8000, VH-Z75 manufactured by Keyence Corporation) or the like, the size of the tobacco filler is measured from a microscopic image, and the surface area is calculated. More preferably, the surface area of the tobacco filler can be more accurately measured by using a microscope capable of three-dimensional measurement, such as the VR-3000 series manufactured by Keyence Corporation. Simply, the size of the tobacco filler can be measured using CAMSIZER manufactured by Retsch Technology Gmbh. CAMSIZER is a device that photographs an object with a CCD camera and performs image processing to measure the size (particle diameter). Simply, the size of the tobacco filler can be measured by sorting the sizes using a sieve.

A tobacco filler having a cubic shape with a side of 0.5 mm has a volume of 0.125 $mm^3$, a surface area of 1.5 $mm^2$, and a surface area-equivalent sphere diameter of 0.66 mm according to the definition of this specification. On the other hand, a tobacco filler having a regular quadrangular prism shape with sides of 0.5 mm, 0.5 mm, and 0.75 mm has a volume of 0.1875 $mm^3$, a surface area of 2.0 $mm^2$, and a surface area-equivalent sphere diameter of 0.71 mm according to the definition of this specification.

According to a preferable embodiment, a non-combustion type inhalation article of the present invention comprises a tobacco filler having a tobacco particle density of not more than 0.51 $g/cm^3$ and having carbonate or hydrogencarbonate added. According to a further preferable embodiment, a non-combustion type inhalation article of the present invention comprises a tobacco filler having a tobacco particle density of not more than 0.50 $g/cm^3$ and having carbonate or hydrogencarbonate added. According to a further preferable embodiment, a non-combustion type inhalation article of the present invention comprises a tobacco filler having a tobacco particle density of not more than 0.42 $g/cm^3$ and having carbonate or hydrogencarbonate added.

According to another preferable embodiment, a non-combustion type inhalation article of the present invention comprises a molded body of cut tobacco, the molded body having a tobacco particle density of not more than 0.51 $g/cm^3$. According to a further preferable embodiment, a non-combustion type inhalation article of the present invention comprises a molded body of cut tobacco, the molded body having a tobacco particle density of not more than 0.50 $g/cm^3$. According to a further preferable embodiment, a non-combustion type inhalation article of the present invention comprises a molded body of cut tobacco, the molded body having a tobacco particle density of not more than 0.42 $g/cm^3$.

According to another preferable embodiment, a non-combustion type inhalation article of the present invention comprises a molded body of cut tobacco, the molded body having a tobacco particle density of not more than 0.51 $g/cm^3$ and having carbonate or hydrogencarbonate added. According to a further preferable embodiment, a non-combustion type inhalation article of the present invention comprises a molded body of cut tobacco, the molded body having a tobacco particle density of not more than 0.50 $g/cm^3$ and having carbonate or hydrogencarbonate added. According to a further preferable embodiment, a non-combustion type inhalation article of the present invention comprises a molded body of cut tobacco, the molded body having a tobacco particle density of not more than 0.42 $g/cm^3$ and having carbonate or hydrogencarbonate added. According to another preferable embodiment, a non-combustion type inhalation article of the present invention comprises a tobacco filler having a tobacco particle density of not more than 0.51 g/cm$^3$ and having a surface area-equivalent sphere diameter of not more than 1.0 mm, preferably not more than 0.75 mm. According to a further preferable embodiment, a non-combustion type inhalation article of the present invention comprises a tobacco filler having a tobacco particle density of not more than 0.50 g/cm$^3$ and having a surface area-equivalent sphere diameter of not more than 1.0 mm, preferably not more than 0.75 mm. According to a further preferable embodiment, a non-combustion type inhalation article of the present invention comprises a tobacco filler having a tobacco particle density of not more than 0.42 g/cm$^3$ and having a surface area-equivalent sphere diameter of not more than 1.0 mm, preferably not more than 0.75 mm.

According to another preferable embodiment, a non-combustion type inhalation article of the present invention comprises a tobacco filler having a tobacco particle density of not more than 0.51 g/cm$^3$, having a surface area-equivalent sphere diameter of not more than 1.0 mm, preferably not more than 0.75 mm, and having carbonate or hydrogencarbonate added. According to a further preferable embodiment, a non-combustion type inhalation article of the present invention comprises a tobacco filler having a tobacco particle density of not more than 0.50 g/cm$^3$, having a surface area-equivalent sphere diameter of not more than 1.0 mm, preferably not more than 0.75 mm, and having carbonate or hydrogencarbonate added. According to a further preferable embodiment, a non-combustion type inhalation article of the present invention comprises a tobacco filler having a tobacco particle density of not more than 0.42 g/cm$^3$, having a surface area-equivalent sphere diameter of not more than 1.0 mm, preferably not more than 0.75 mm, and having carbonate or hydrogencarbonate added.

According to another preferable embodiment, a non-combustion type inhalation article of the present invention comprises a molded body of cut tobacco, the molded body having a tobacco particle density of not more than 0.51 g/cm$^3$ and having a surface area-equivalent sphere diameter of not more than 1.0 mm, preferably not more than 0.75 mm. According to a further preferable embodiment, a non-combustion type inhalation article of the present invention comprises a molded body of cut tobacco, the molded body having a tobacco particle density of not more than 0.50 g/cm$^3$ and having a surface area-equivalent sphere diameter of not more than 1.0 mm, preferably not more than 0.75 mm. According to a further preferable embodiment, a non-combustion type inhalation article of the present invention comprises a molded body of cut tobacco, the molded body having a tobacco particle density of not more than 0.42 g/cm$^3$ and having a surface area-equivalent sphere diameter of not more than 1.0 mm, preferably not more than 0.75 mm.

According to another preferable embodiment, a non-combustion type inhalation article of the present invention comprises a molded body of cut tobacco, the molded body having a tobacco particle density of not more than 0.51 g/cm$^3$, having a surface area-equivalent sphere diameter of not more than 1.0 mm, preferably not more than 0.75 mm, and having carbonate or hydrogencarbonate added. According to a further preferable embodiment, a non-combustion type inhalation article of the present invention comprises a molded body of cut tobacco, the molded body having a tobacco particle density of not more than 0.50 g/cm$^3$, having a surface area-equivalent sphere diameter of not more than 1.0 mm, preferably not more than 0.75 mm, and having carbonate or hydrogencarbonate added. According to a further preferable embodiment, a non-combustion type inhalation article of the present invention comprises a molded body of cut tobacco, the molded body having a tobacco particle density of not more than 0.42 g/cm$^3$, having a surface area-equivalent sphere diameter of not more than 1.0 mm, preferably not more than 0.75 mm, and having carbonate or hydrogencarbonate added.

EXAMPLES

Example 1

(1) Preparation of Molded Body of Cut Tobacco

Burley cut tobacco was crushed by a mill, and then sieved with a sieve having a mesh opening of 0.5 mm to provide a tobacco powder having a size of less than 0.5 mm.

The tobacco powder, water and potassium carbonate were mixed in amounts of 10 g, 0.94 g and 2.2 g, respectively, and the resulting mixture was placed in a cylindrical container and mixed by rotating overnight (for 12 hours) to be homogenized.

150 mg of the foregoing homogenized mixture was placed in an empty metal cylinder (inner diameter being 21 mm) to be compressed with a piston from above the metal cylinder, and thus to be molded, whereby a molded body of cut tobacco was obtained. The compressive force during molding was 1 MPa, 2 MPa, 4 MPa, 6 MPa, or 8 MPa. The "tobacco particle density" of the molded body of cut tobacco was calculated from the volume and mass by measuring the height, diameter, and mass of the molded body of cut tobacco obtained by compression molding.

When compression molding was carried out at 1 MPa, the resulting molded body (Sample No. 1) had a height of 1.67 mm, a diameter of 21.0 mm, a mass of 150 mg, a volume of 578 mm$^3$, a surface area of 803 mm$^2$, and a tobacco particle density of 0.259 mg/mm$^3$. When compression molding was carried out at a compression force of 2 MPa, the resulting molded body (Sample No. 2) had a height of 1.03 mm, a diameter of 21.0 mm, a mass of 150 mg, a volume of 357 mm$^3$, a surface area of 761 mm$^2$, and a tobacco particle density of 0.420 mg/mm$^3$. When compression molding was carried out at a compression force of 4 MPa, the resulting molded body (Sample No. 3) had a height of 0.86 mm, a diameter of 21.0 mm, a mass of 150 mg, a volume of 298 mm$^3$, a surface area of 749 mm$^2$, and a tobacco particle density of 0.504 mg/mm$^3$. When compression molding was carried out at a compression force of 6 MPa, the resulting molded body (Sample No. 4) had a height of 0.84 mm, a diameter of 21.0 mm, a mass of 150 mg, a volume of 291 mm$^3$, a surface area of 748 mm$^2$, and a tobacco particle density of 0.516 mg/mm$^3$. When compression molding was carried out at a compression force of 8 MPa, the resulting molded body (Sample No. 5) had a height of 0.67 mm, a diameter of 21.0 mm, a mass of 150 mg, a volume of 232 mm$^3$, a surface area of 737 mm$^2$, and a tobacco particle density of 0.646 mg/mm$^3$.

The surface area-equivalent sphere diameters of Sample Nos. 1 to 5 were 16.0 mm, 15.6 mm, 15.4 mm, 15.4 mm, and 15.3 mm in an ascending order of the density of the molded body.

Figure 2:
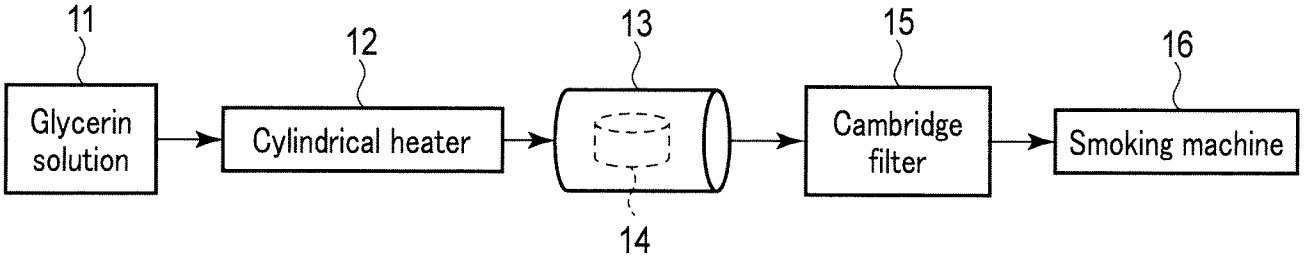
FIG. 2 is a view for explaining a method of collecting a tobacco flavor component released from the tobacco filler.

(2) Collection of Tobacco Flavor Component Released from Molded Body of Cut Tobacco The tobacco flavor component released from the molded body of cut tobacco was collected as follows. A method of collecting the tobacco flavor component will be described with reference to FIG. 2.

A molded body 14 of cut tobacco thus obtained (one of Sample Nos. 1 to 5) was placed in an empty bottomless cylindrical body 13 (inner diameter being about 21 mm), and then a glycerin solution 11 (2 μL per puff) was injected from above into a cylindrical heater 12 (ceramic cylindrical heater having an inner diameter of 2 mm and a length of 30 mm, heating temperature being 250° C.) disposed upstream thereof. When inhalation was carried out by a smoking machine 16 (55 cc was inhaled with a rectangular wave for 2 seconds) disposed downstream of the bottomless cylindrical body 13 accommodating the molded body 14 of cut tobacco, glycerin aerosol was generated. The glycerin aerosol was circulated inside the bottomless cylindrical body 13 accommodating the molded body 14 of cut tobacco. The glycerin aerosol coming out from the downstream side of the bottomless cylindrical body 13 accommodating the molded body 14 of cut tobacco was collected by a Cambridge filter 15. The collected glycerin aerosol contains the tobacco flavor component released from the molded body 14 of cut tobacco. The Cambridge filter was exchanged every 5 puffs, and the glycerin aerosol was collected up to 50 puffs in total. Puff inhalation was carried out continuously.

(3) Analysis of Collected Tobacco Flavor Component

The tobacco flavor component contained in the collected glycerin aerosol was quantitatively analyzed with a gas chromatograph (FID was used as a detector). In this experiment, nicotine was chosen as the tobacco flavor component to be analyzed from the viewpoint that measurement was easily performed.

Although in this experiment the glycerin aerosol was circulated through the molded body of cut tobacco to measure the collected amount of the tobacco flavor component, the tobacco flavor component was collected even by circulating only the atmosphere (air) through the molded body of cut tobacco without using the glycerin aerosol. However, when only the atmosphere (air) is circulated through the molded body of cut tobacco, the collected amount of the tobacco flavor component is lower as compared with the case where aerosol is circulated. Thus, in this experiment, in order to facilitate the measurement of the collected amount of the tobacco flavor component, glycerin aerosol was circulated through the molded body of cut tobacco. Examples of the liquid for generating aerosol include propylene glycol in addition to glycerin, and a chemical composition of the aerosol to be circulated through the molded body of cut tobacco is not limited to glycerin and propylene glycol.

(4) Result

Figure 3:
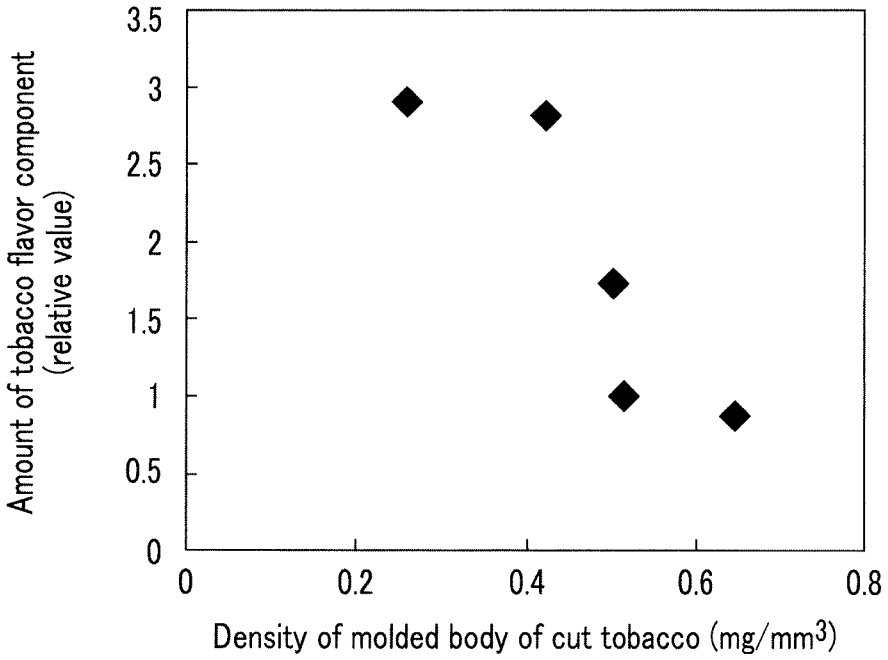
FIG. 3 is a graph showing a relationship between the density of a molded body of cut tobacco and the amount (relative value) of the tobacco flavor component.
Figure 4:
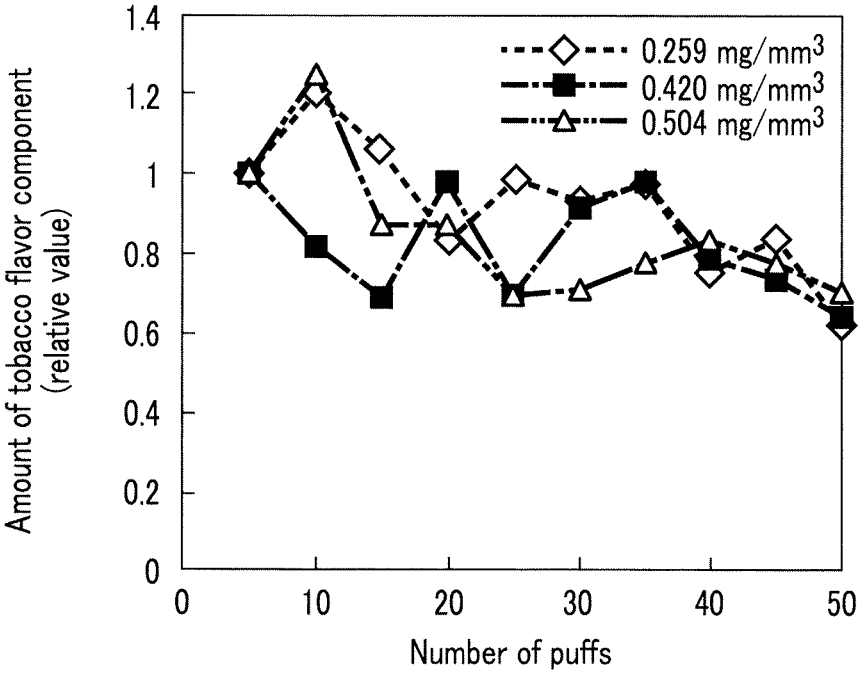
FIG. 4 is a graph showing a relationship between the number of puffs and the amount (relative value) of the tobacco flavor component when using a low-density molded body of cut tobacco.

The amount (relative value) of the tobacco flavor component (nicotine in this example) collected by the recovered Cambridge filter is shown in FIGS. 3 and 4.

FIG. 3 shows a relationship between the density of the molded body of cut tobacco and the amount (relative value) of the tobacco flavor component. In FIG. 3, "the amount (relative value) of the tobacco flavor component" is represented by a ratio (b/a) of the amount (b) of the tobacco flavor component obtained in each sample (Sample Nos. 1 to 5) to the amount (a) of the tobacco flavor component obtained in Sample No. 4, wherein "the amount of the tobacco flavor component" denotes a value (mg/(puff·mm$^2$)) obtained by dividing the total amount (mg) of the tobacco flavor component collected up to 50 puffs by the surface area (mm$^2$) of the molded body of cut tobacco and the number of puffs (50 times).

FIG. 3 shows that when the tobacco particle density of the molded body of cut tobacco is reduced to not more than 0.504 mg/mm$^3$ (that is, not more than 0.504 g/cm$^3$), the amount of the tobacco flavor component released from the molded body of cut tobacco increases. FIG. 3 further shows that when the tobacco particle density of the molded body of cut tobacco is reduced to not more than 0.420 mg/mm$^3$ (that is, not more than 0.420 g/cm$^3$), the amount of the tobacco flavor component released from the molded body of cut tobacco markedly increases. This result is considered to be due to the fact that the porosity inside the molded body of cut tobacco increases, so that the density of the molded body of cut tobacco is lowered, whereby the tobacco flavor component (for example, nicotine) present inside the molded body of cut tobacco is likely to move to the surface of the molded body, and the amount of the tobacco flavor component released from the surface of the molded body increases.

FIG. 4 shows how the amount of the tobacco flavor component released from the molded body of cut tobacco varies according to the number of puffs. In FIG. 4, the amount (relative value) of the tobacco flavor component is represented by the ratio (b/a) of the amount (b) of the tobacco flavor component collected by the Cambridge filter recovered after each puff to the amount (a) of the tobacco flavor component collected by the Cambridge filter recovered after 5 puffs.

In FIG. 4, the white diamond-shaped mark indicates the result of a molded body of cut tobacco having a tobacco particle density of 0.259 mg/mm$^3$, the black square mark indicates the result of a molded body of cut tobacco having a tobacco particle density of 0.420 mg/mm$^3$, and the white triangle mark indicates the result of a molded body of cut tobacco having a tobacco particle density of 0.504 mg/mm$^3$.

In all of the above three samples (that is, low-density molded bodies of cut tobacco), the amount of the tobacco flavor component denotes a value of about 0.8 to about 1.0 at the time of 20 consecutive puffs and denotes a value of about 0.6 to about 0.7 at the time of 50 consecutive puffs. A similar experiment was carried out using cut tobacco having a usual density (cut tobacco not subjected to expansion treatment) in Example 2 (FIG. 5) described later. In the cut tobacco having a usual density, the amount of the tobacco flavor component decreased to about 0.4 at the time of 20 consecutive puffs. These results show that when the tobacco particle density of the molded body of cut tobacco is reduced to not more than 0.504 mg/mm$^3$ (that is, not more than 0.504 g/cm$^3$), the amount of the tobacco flavor component at the beginning of inhalation can be stably maintained even when the number of puffs increases. These results are considered to be due to the fact that the porosity inside the molded body of cut tobacco increases, so that the density of the molded body of cut tobacco is lowered, whereby the tobacco flavor component (for example, nicotine) present inside the molded body of cut tobacco is likely to move to the surface of the molded body, and the tobacco flavor component can continuously move to the surface of the molded body even after the number of puffs increases.

Although in this experiment nicotine was chosen as the subject of measurement of the tobacco flavor component, also for the tobacco flavor components other than nicotine, the amount released from the surface of the molded body can be increased by reducing the density of the molded body of cut tobacco.

Example 2

(1) Method

The cut tobacco (cut tobacco not subjected to expansion treatment) was used instead of the molded body of cut tobacco, and as in Example 1, the tobacco flavor component released from the cut tobacco was collected (see FIG. 2) and analyzed.

In this experiment, Burley cut tobacco was crushed by a mill, then sieved with two kinds of sieves having mesh openings of 0.5 mm and 1.18 mm, and the resulting 0.5 to 1.18 mm cut tobacco was used. In this experiment, potassium carbonate was added to cut tobacco as in the case of the molded body of cut tobacco. Specifically, 0.94 g of pure water and 2.2 g of a potassium carbonate powder were mixed with 10 g of cut tobacco, and the resulting mixture was placed in a cylindrical container and mixed by rotating (80 rpm) overnight (for 12 hours) to be homogenized. Moreover, instead of a bottomless cylindrical body (inner diameter being about 21 mm) (reference numeral 3 of FIG. 2) accommodating the molded body of cut tobacco, a bottomless cylindrical body (inner diameter being 8 mm) filled with cut tobacco (150 mg including potassium carbonate) was used. In this case, in order to prevent the cut tobacco from moving from a predetermined position in the bottomless cylindrical body, a nonwoven fabric was attached to both entrance and exit portions of the bottomless cylindrical body. A Cambridge filter was exchanged every 5 puffs, and glycerin aerosol was collected up to 20 puffs in total. Nicotine contained in the collected glycerin aerosol was quantitatively analyzed with a gas chromatograph (FID was used as a detector).

(2) Result

Figure 5:
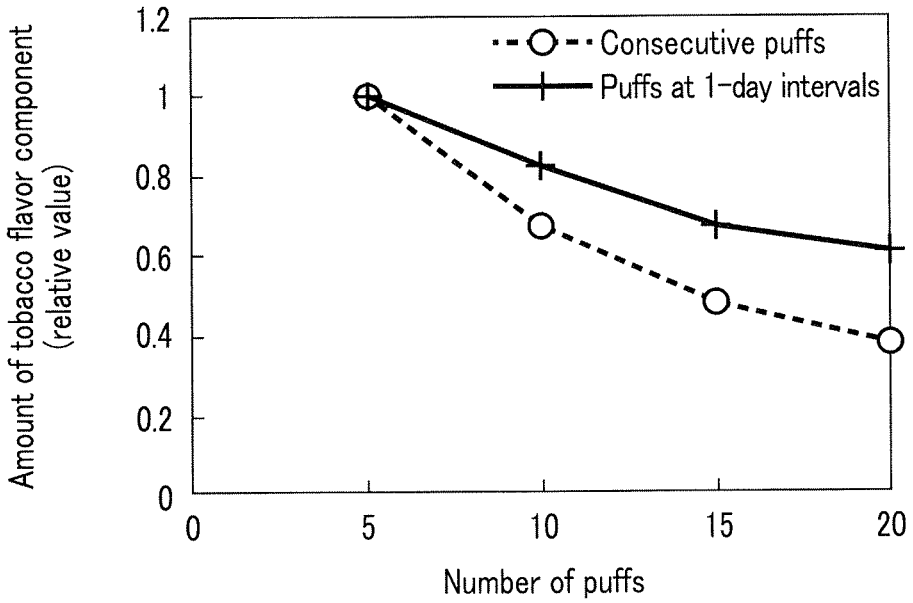
FIG. 5 is a graph showing a relationship between the number of puffs and the amount (relative value) of the tobacco flavor component when using usual cut tobacco.

The amount of the tobacco flavor component (nicotine in this example) collected by the recovered Cambridge filter is shown in FIG. 5. FIG. 5 shows how the amount of the tobacco flavor component released from the cut tobacco having a usual density varies according to the number of puffs. In FIG. 5, the amount (relative value) of the tobacco flavor component is represented by the ratio (b/a) of the amount (b) of the tobacco flavor component collected by the Cambridge filter recovered after each puff to the amount (a) of the tobacco flavor component collected by the Cambridge filter recovered after 5 puffs.

In FIG. 5, "consecutive puffs" indicate the amount of the tobacco flavor component in a case where 20 puffs are continuously performed, and "puffs at 1-day intervals" indicate the amount of the tobacco flavor component in a case where initial 5 puffs are performed, 5 puffs (10 puffs in total) are further performed two days later, 5 puffs (15 puffs in total) are further performed two days later, and 5 puffs (20 puffs in total) are further performed two days later.

When 20 puffs were continuously performed, the amount of the tobacco flavor component decreased sharply as the number of puffs increased, and decreased to about 0.4 after 20 puffs. After 20 puffs, when the content of nicotine in cut tobacco was measured, the content of nicotine in the cut tobacco hardly decreased as compared with the content of nicotine in the cut tobacco before consecutive puffs. From this fact, it is considered that when consecutive puffs are performed, the tobacco flavor component present near the surface of the cut tobacco is released from the surface of the cut tobacco, and the tobacco flavor component present inside the cut tobacco stays inside the cut tobacco without moving to the surface of the cut tobacco.

On the other hand, when puffs were performed at 1-day intervals, the amount of the tobacco flavor component became less likely to decrease as the number of puffs increased, as compared with the case of the consecutive puffs. This is considered to be due to the fact that the tobacco flavor component present inside the cut tobacco moves to the cut tobacco surface during the period when puff was not performed, whereby the tobacco flavor component is supplied to the cut tobacco surface, and thus released.

From these results, in the case of the cut tobacco having a usual density, it is understood that the speed at which the tobacco flavor component present inside the cut tobacco moves to the cut tobacco surface is lower as compared with the low-density molded body of cut tobacco (Example 1).

From the results in FIG. 5, it is understood that the tobacco flavor component is released mainly from the surface of the tobacco filler, and as a result, the following formula can be derived.

$$N_T = N_0 S_{LT} \quad \text{[Formula 1]}$$

$N_T$: total release amount of tobacco flavor component per puff (mg/puff)

$N_0$: release amount of tobacco flavor component per unit surface area per puff (mg/(puff·mm$^2$))

$S_{LT}$: total surface area of total tobacco filler (mm$^2$)

This formula shows that in order to increase the total release amount ($N_T$) of the tobacco flavor component, it is sufficient to increase the total surface area ($S_{LT}$) of the total tobacco filler or the release amount ($N_0$) of the tobacco flavor component per unit surface area per puff.

Examples of a method for increasing the total surface area ($S_{LT}$) of the total tobacco filler include increasing the size of the tobacco filler, increasing the number of the tobacco fillers, and changing the shape of the tobacco filler so as to increase the surface area (for example, thinning the tobacco filler). Examples of a method for increasing the total surface area ($S_{LT}$) without increasing the amount of the tobacco filler used include increasing the number of the tobacco fillers while decreasing the size of the tobacco filler, and changing the shape of the tobacco filler so as to increase the surface area.

From the above experimental results, examples of a method for increasing the release amount ($N_0$) of the tobacco flavor component per unit surface area per puff include reducing the density of the tobacco filler.

From the above, the amount of the tobacco flavor component released from the tobacco filler during inhalation of the non-combustion type inhalation article can be increased by reducing the density of the tobacco filler, whereby the amount of the tobacco filler used in the non-combustion type inhalation article can be reduced, so that the use cost of the tobacco filler can be reduced. In addition to reducing the density of the tobacco filler, increasing the number of the tobacco fillers while decreasing the size of the tobacco filler, or changing the shape of the tobacco filler so as to increase the surface area is also effective in reducing the use cost of the tobacco filler.

What is claimed is:

1. A heating type inhalation article comprising:

a total tobacco filler formed of a plurality of tobacco filler units, each of the tobacco filler units having a tobacco particle density of not more than 0.51 g/cm$^3$; and a heating part which heats the total tobacco filler to such an extent that the total tobacco filler does not burn, wherein each of the tobacco filler units is a molded article of cut tobacco, the total tobacco filler has a 50% particle diameter (D50) of not more than 1.0 mm, and a plurality of the molded articles are disposed in the heating type inhalation article to constitute the total tobacco filler.

2. The heating type inhalation article according to claim 1, wherein the total tobacco filler comprises added carbonate or hydrogencarbonate.

3. The heating type inhalation article according to claim 2, wherein the tobacco particle density of the individual tobacco filler unit is not more than 0.42 $g/cm^3$.

4. The heating type inhalation article according to claim 1, wherein the tobacco particle density of the individual tobacco filler unit is not more than 0.42 $g/cm^3$.

5. The heating type inhalation article according to claim 1, wherein each of the tobacco filler units has a surface area-equivalent sphere diameter of not more than 1.0 mm.

6. The heating type inhalation article according to claim 1, wherein each of the tobacco filler units has a surface area-equivalent sphere diameter of not more than 0.75 mm.

7. The heating type inhalation article according to claim 1, wherein the plurality of tobacco filler units are present in an amount of not less than 1% by mass with respect to the total tobacco fillers included in the non combustion heating type inhalation article.

8. The heating type inhalation article according to claim 1, wherein the tobacco filler units each have a shape of cylindrical column or quadrangular prism.

9. The heating type inhalation article according to claim 1, wherein each of the tobacco filler units has a surface area-equivalent sphere diameter of 0.1 mm to 1.0 mm.

10. The heating type inhalation article according to claim 1, wherein the 50% particle diameter (D50) of the total tobacco filler is not more than 0.75 mm.

* * * * *